United States Patent [19]

Katzmark

[11] 4,045,029

[45] Aug. 30, 1977

[54] AERODYNAMIC ORIFICED DISC

[76] Inventor: Peter C. Katzmark, 3668 Tilden, Los Angeles, Calif. 90034

[21] Appl. No.: 645,713

[22] Filed: Dec. 31, 1975

[51] Int. Cl.[2] ..... A63H 27/00

[52] U.S. Cl. ..... 273/106 B

[58] Field of Search ..... 273/106 B, 106 R, 105.4; 46/74 D, 82-85; D34/15

[56] References Cited

U.S. PATENT DOCUMENTS

| | | | |
|---|---|---|---|
| 2,640,296 | 6/1953 | Johnson et al. | 46/74 D X |
| 3,082,572 | 3/1963 | Knox, Jr. | 46/75 X |
| 3,082,977 | 3/1963 | Arlin | 46/75 UX |
| 3,312,472 | 4/1967 | Kerr | 273/106 B |
| 3,765,122 | 10/1973 | English | 273/106 B UX |
| D. 209,763 | 1/1968 | Mueller | 273/106 B UX |

*Primary Examiner*—Paul E. Shapiro
*Attorney, Agent, or Firm*—William H. Pavitt, Jr.

[57] ABSTRACT

A thin disc, preferably of plastic, having an outer annular area which is upwardly convex and an annular inner area integral with the outer annular area and which slopes downwardly toward the disc axis to terminate in an annular edge which defines a coaxial circular opening. The radius of the opening may vary from a quarter of an inch up to almost one-half of the radius of the complete disc. In one embodiment of the invention, where the central opening is of the larger size, a plurality of dihedral vanes may be provided to extend between an object centrally disposed in the orifice and the inner edge of the disc defining the central opening. Such vanes may either extend radially from the centrally disposed object, or may spiral outwardly therefrom, with their leading edges being thickened and similarly disposed to provide added lift to the disc when it is pitched in a spinning motion.

1 Claim, 9 Drawing Figures

FIG. 1
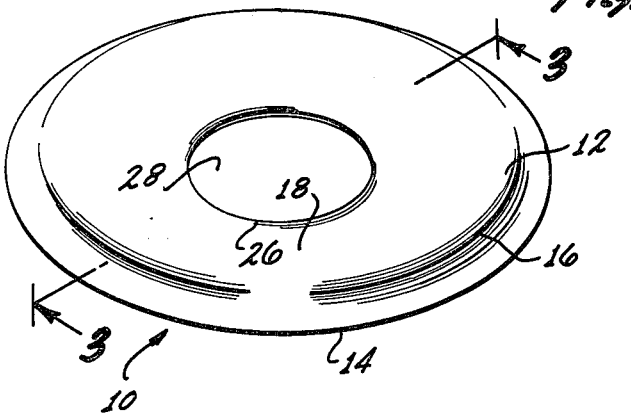
FIG. 2
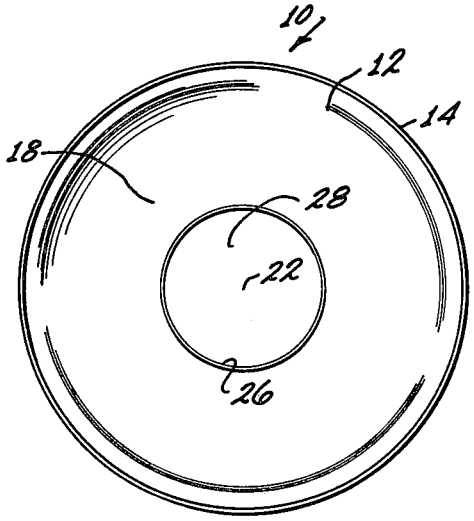
FIG. 3
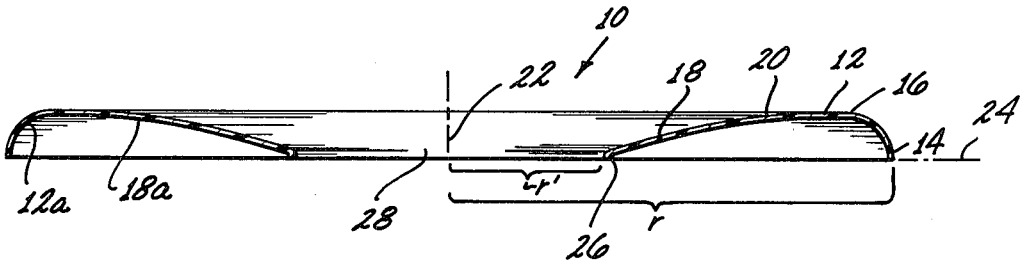
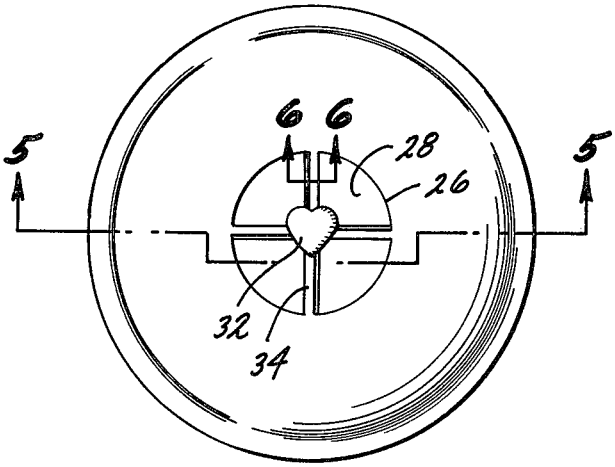
FIG. 4

AERODYNAMIC ORIFICED DISC

BACKGROUND OF THE INVENTION

1. Field of the Invention

This invention relates to that class of circular toys which are intended to be pitched in a spinning motion by one person in the direction of, and to be caught by, a second person.

2. Description of the Prior Art

For at least the past 10 years, various types of plastic discs and rings have been manufactured and sold as toys to be pitched in a spinning motion by one person toward another person who is expected to try to catch the disc or ring as the course of its flight approaches the latter person. Examples of patents disclosing discs or rings of this type are the U.S. Pat. Nos. 3,312,472 issued to R.A. Kerr, Apr. 4, 1967; 3,359,678 issued to E.E. Headrick, Dec. 26, 1967; 3,580,580 issued to John W. Mark, May 25, 1971; and 3,765,122 issued Oct. 16, 1973 to Roy English.

Where the disc is not orificed, good aerodynamic lift may result from properly configuring the disc. However, because of the amount of plastic material which must be employed to provide a solid disc, discs of this nature may not ordinarily be made cheaply enough to be given away for advertising purposes. When, however, the toy is made in the form of a relatively thin ring, problems from the standpoint of aerodynamic stability may result, such that the person throwing the ring may have to throw it in a very precise manner in order to obtain the desired supporting lift to launch it and have it maintained on its desired course.

SUMMARY OF THE INVENTION

The present invention provides an orificed disc whereby, particularly where it is provided with a larger size orifice, considerably less plastic material may be required to fabricate it than is required for a solid disc of the Headrick type. On the other hand, it is a feature of the present invention not to make the centrally disposed orifice so large as to create aerodynamic instability of the disc in flight. Indeed, in one embodiment of the invention, the orifice may be quite small. In another embodiment, the orifice may be partially filled with a centrally disposed object which is supported with reference to the inner periphery of the disc annulus by a plurality of dihedral elements extending inwardly from such periphery to the object. Such elements in a still further embodiment of the invention may be spiralled to present thickened dihedral leading edges to further improve the aerodynamic lift of the disc. The central object may be personalized for the purchaser or it may include some symbol or other device advertising some product or service of a company which may be distributing the discs as a part of an advertising campaign. Desirably, all of the orificed discs of the present invention are integrally molded, even where they include a centrally disposed object supported by the inwardly extending elements.

Because of the unusual aerodynamic lift characteristics of orificed discs made according to the present invention, even when such discs are made in relatively small sizes, such discs may be molded inexpensively enough to be given away as advertising items or as premiums to be exchanged for box-tops or coupons of the company advertising some particular product.

BRIEF DESCRIPTION OF THE DRAWINGS

In the accompanying drawings:

FIG. 1 is a perspective view of the preferred embodiment of the invention;

FIG. 2 is a top plan view of the embodiment of the invention shown in FIG. 1;

FIG. 3 is a section on the line 3—3 and looking in the direction of the arrows in FIG. 1;

FIG. 4 is a top plan view of another embodiment of the invention;

DESCRIPTION OF THE PREFERRED EMBODIMENT

Figure 5:
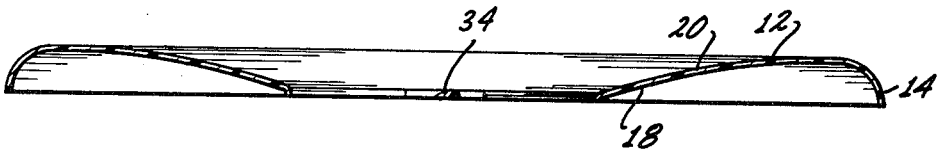
FIG. 5 is a section on the line 5—5 and looking in the direction of the arrows in FIG. 4.

In the embodiment of the invention illustrated in FIGS. 1 through 3, inclusive, the disc is formed of an outer annular convex area 12 having its outer periphery 14 at a level below the apex 16 of the annular area 12. Formed integrally with the convex area 12 is an inner annular section 18 which slopes gradually down from its ring of joinder 20 with the convex annular area 12 to terminate annularly and radially outwardly of the disc axis 22 at an edge 26 lying in the plane 24 in which also lies the annular periphery 14 of the convex annular portion 12 of the disc. The inner annular edge 26 of the section 18 defines a centrally disposed opening 28 in the disc. It is a feature of the present invention that the radius $r'$ of the opening 28 shall be less than one-half of the radius $r$ (see FIG. 3 of the disc 10).

Figure 9:
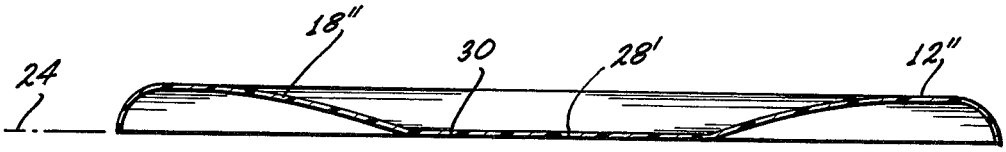
FIG. 9 is a section taken on the line 9—9 and looking in the direction of the arrows in FIG. 8.

In the embodiment of the invention illustrated in FIG. 9, a further inner annular section 30 is provided to lie in the plane 24 being preferably integrally molded with the annular section 18. By including such further inner annular section 30, the orifice 28 may be reduced to a very small size, such as is illustrated at 28' in FIG. 9.

Figure 6:
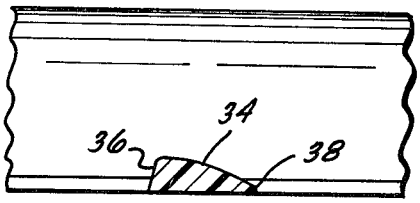
FIG. 6 is a section taken on the line 6—6 and looking in the direction of the arrows in FIG. 4.

In the embodiment of the invention illustrated in FIGS. 4, 5 and 6, an object 32, which may be decorative, may be disposed centrally in the orifice 28, being supported in such disposition by a plurality of dihedral elements 34 which desirably may be integrally molded with the inner edge 26 of the annular section 18 and also with the object 32 itself. The elements 34, preferably should be formed as dihedrals (best shown in FIG. 6), having thicker leading edges 36 and sloping down from such leading edges to thin trailing edges 38. If the thicker edges 36 are similarly disposed in each element 34, it will be appreciated by those skilled in the art that the elements 34 will provide an added lift to the disc when it is spun in such a way that the thickened edges 36 lead as to first strike the air as the disc is spun. For example, the disc shown in FIG. 4 would be for a left-handed person who holds the disc inwardly toward his abdomen with his left hand and then proceeds to spin it by flicking his wrist outwardly.

Figure 7:
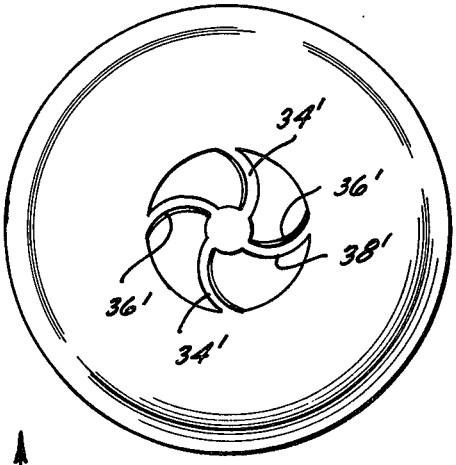
FIG. 7 is a top plan view of a still further embodiment of the invention.

On the other hand, the embodiment of the invention illustrated in FIG. 7 would be suited for a right-handed person flicking the disc in an opposite manner. The FIG. 7 embodiment, however, by its spiralling elements 34′ will be found to provide a greater amount of added lift because of the increased length of the elements 34′ over the length of the elements 34 in the FIG. 4 embodiment.

In use, it will be found that the orifice discs of the present invention may be projected spinningly in the same manner as the solid type discs of the Headrick patent, which are popularly known by the name "Frisbee". As the disc 10 is thus spun in a plane substantially parallel to the ground, or even at some angle with respect thereto, air will flow over the convex section 12 down the inner annular section 18, and through the orifice 28 and thence to the underside 18*a* of the section 18 and into the concavity 12*a* of the underside of the section 12 to provide lift to the trailing, spinning part of the disc 10.

In the embodiments illustrated in FIGS. 4 through 7, an added amount of lift is developed as the leading edges 36 or 36′ strike the air as it passes through the orifice 28.

Figure 8:
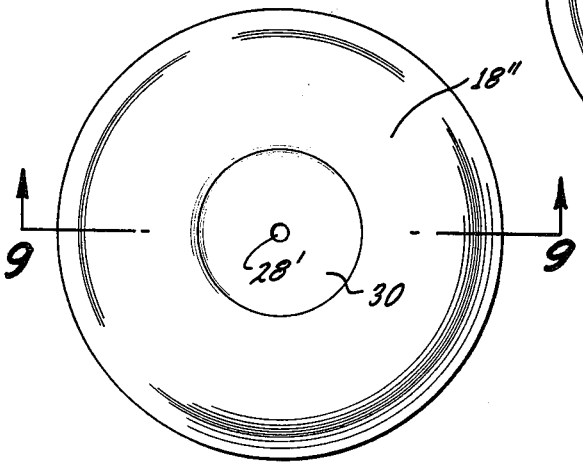
FIG. 8 is a top plan view of a still further embodiment of the invention.

In the embodiment of FIGS. 8 and 9, however, only a very small portion of the air will be found to pass through the orifice 28′, so that substantially all of the lift will be developed by the two integrally joined annular sections 12″ and 18″.

It will be appreciated, however, that where the embodiments of FIGS. 1 through 7 are adopted with the fairly large orifices 28, a substantial saving in the plastic material required to form the disc may be effected over that amount required to form a completely solid disc and such saving may be effected without adversely affecting the aerodynamic capability and stability of the toy.

I claim:

1. A toy centrally orificed circular disc having such aerodynamic capability as to enable said disc to sustain itself in stable flight when projected with a spin in a plane substantially parallel to the ground, said disc comprising:

A. a convexly raised outer annular portion, the periphery of said outer annular portion being at a lower level than the apex of the convex of said outer portion; and B. an inner annular portion, said inner annular portion being i. integral with said convexly raised outer annular portion;

ii. sloping inwardly toward the axis of the disc; and iii. terminating in an annular edge defining a central orifice, the radius of said orifice being less than one-half of the radius of the entire disc, but said central orifice being of a sufficient diameter to permit an object to be supportively disposed in said orifice and spaced from said last-mentioned annular edge;

C. An object so disposed in said central orifice and supported in said disc position by a plurality of dihedral elements extending spirally inwardly from said annular edge defining the central orifice, the leading edges of said elements being on the same sides of the elements to present extended dihedral leading edges when the disc is spun in a predetermined direction, thereby to provide additional aerodynamic lift capability.

* * * * *